US009957770B2

(12) United States Patent
Averill et al.

(10) Patent No.: US 9,957,770 B2
(45) Date of Patent: May 1, 2018

(54) ANNULAR BLOWOUT PREVENTER (BOP) PACKING UNIT WITH INTEGRATED SECONDARY SEALING COMPOUND

(71) Applicants: William Stephen Averill, Cypress, TX (US); Michael James Fuller, Cypress, TX (US); Dana Earl Witt, Katy, TX (US)

(72) Inventors: William Stephen Averill, Cypress, TX (US); Michael James Fuller, Cypress, TX (US); Dana Earl Witt, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 564 days.

(21) Appl. No.: 14/595,761

(22) Filed: Jan. 13, 2015

(65) Prior Publication Data

US 2016/0201422 A1 Jul. 14, 2016

(51) Int. Cl.
*E21B 33/06* (2006.01)

(52) U.S. Cl.
CPC ..... *E21B 33/06* (2013.01)

(58) Field of Classification Search
CPC .. E21B 33/061–33/064; E21B 33/1208; E21B 33/085; E21B 33/06
USPC ..... 277/332, 645; 251/1.2
See application file for complete search history.

(56) References Cited

U.S. PATENT DOCUMENTS

| | | | | |
|---|---|---|---|---|
| 5,279,365 | A * | 1/1994 | Yenulis | E21B 33/085 166/84.3 |
| 8,176,933 | B2 * | 5/2012 | Huff | B29C 35/0222 137/315.02 |
| 8,602,688 | B2 * | 12/2013 | Hansen | E21B 17/206 166/387 |
| 9,441,443 | B2 * | 9/2016 | Cantlon | E21B 33/062 |
| 2008/0023865 | A1 * | 1/2008 | Butuc | B29C 35/0222 264/40.1 |
| 2009/0229424 | A1 * | 9/2009 | Montgomery | E21B 19/07 81/57.15 |
| 2013/0168578 | A1 * | 7/2013 | Leuchtenberg | E21B 33/06 251/1.3 |

* cited by examiner

*Primary Examiner* — Giovanna C. Wright
(74) *Attorney, Agent, or Firm* — King & Spalding LLP

(57) ABSTRACT

An annular blowout preventer includes a body, a piston disposed within the body, and a packing unit disposed adjacent the piston. The packing unit includes an packer body surrounding an opening. The packer body is fabricated from a first material. The packing unit further includes a second material disposed between the packer body and the opening, the second material being less rigid than the first material. The packer body and the second material constrict the opening when the annular blowout preventer is actuated. The second material creates a seal around a tool disposed within the opening. The second material fills in one or more crevices or recesses on an outer perimeter of the tool.

20 Claims, 4 Drawing Sheets

ANNULAR BLOWOUT PREVENTER (BOP) PACKING UNIT WITH INTEGRATED SECONDARY SEALING COMPOUND

TECHNICAL FIELD

The present invention relates generally to annular blowout preventers. Specifically, the invention relates to sealing wells with irregular shaped pipes/pipe assemblies using an annular blowout preventer having a packing unit with primary and secondary sealing means.

BACKGROUND

During completions and production stages of a well, various tools are installed in the well. For example, electric submersible pumps (ESPs) are an artificial-lift method used which involve a sealed motor and pump placed deep in a well and hung on production tubing. During the installation of the ESP system, thousands of feet of tubing, hydraulic control lines, power cables, and electric control lines are installed in the well through a BOP stack. These lines and cables are typically bundled and clamped together onto the surface of the production tubing.

If a well control event were to occur while these lines and cables are on the production tubing traversing the BOP stack, a blind shear ram (BSR) is typically the only preventer available to seal the well. However, when the BSR is actuated, the production tubing, including the bundle of control lines and cables, are sheared and drop into the well, causing further damage and loss.

One way of sealing a well without shearing the production tubing is the use of ram packers and annular BOPs. Ram packers and annular BOPs are a preferable well control device because they do not cause damage to the bundle and do not sever or drop the ESP assembly into the well. Rather, ram packers and annular BOPs constrict around the production tubing when actuated. However, they are ineffective when used with production tubing having an irregular outer profile, such as when lines and cables are disposed on the production tubing, because the packers cannot fill the crevices and gaps in the irregular profile.

SUMMARY

According to one aspect of the present disclosure, an annular blowout preventer includes a body, a piston disposed within the body, and a packing unit disposed adjacent the piston. The packing unit includes an packer body surrounding an opening and an internal chamber formed within the packer body. The internal chamber is filled with a sealing compound. The packing unit further includes a channel in fluid communication with the chamber and a separation between the channel and the opening. At least a portion of the fluid is expelled through the separation and into the opening when the packing unit is compressed. The packing unit is compressed when the piston is urged against the packing unit during actuation of the annular blowout preventer.

According to another aspect of the present disclosure, an annular blowout preventer includes a body, a piston disposed within the body, and a packing unit disposed adjacent the piston. The packing unit includes an packer body surrounding an opening. The packer body is fabricated from a first material. The packing unit further includes a second material disposed between the packer body and the opening, the second material being less rigid than the first material. The packer body and the second material constrict the opening when the annular blowout preventer is actuated. The second material creates a seal around any tool disposed within the opening. The second material fills in one or more crevices or recesses on an outer perimeter of the tool.

According to another aspect of the present disclosure, a method of sealing a well includes actuating an annular blowout preventer. The blowout preventer includes a piston and a packing unit. The packing unit includes an packer body having an opening formed therethrough. The method also includes urging the piston against the packing unit. The packing unit comprises a first material and a second material, the second material having a rigidity lesser than that of the first material. The method further includes compressing the packing unit and thereby constricting the opening. The method also includes sealing any gaps between a tool and the packing unit with the second material when a tool is disposed through the opening.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DESCRIPTION OF THE INVENTION

Figure 1:
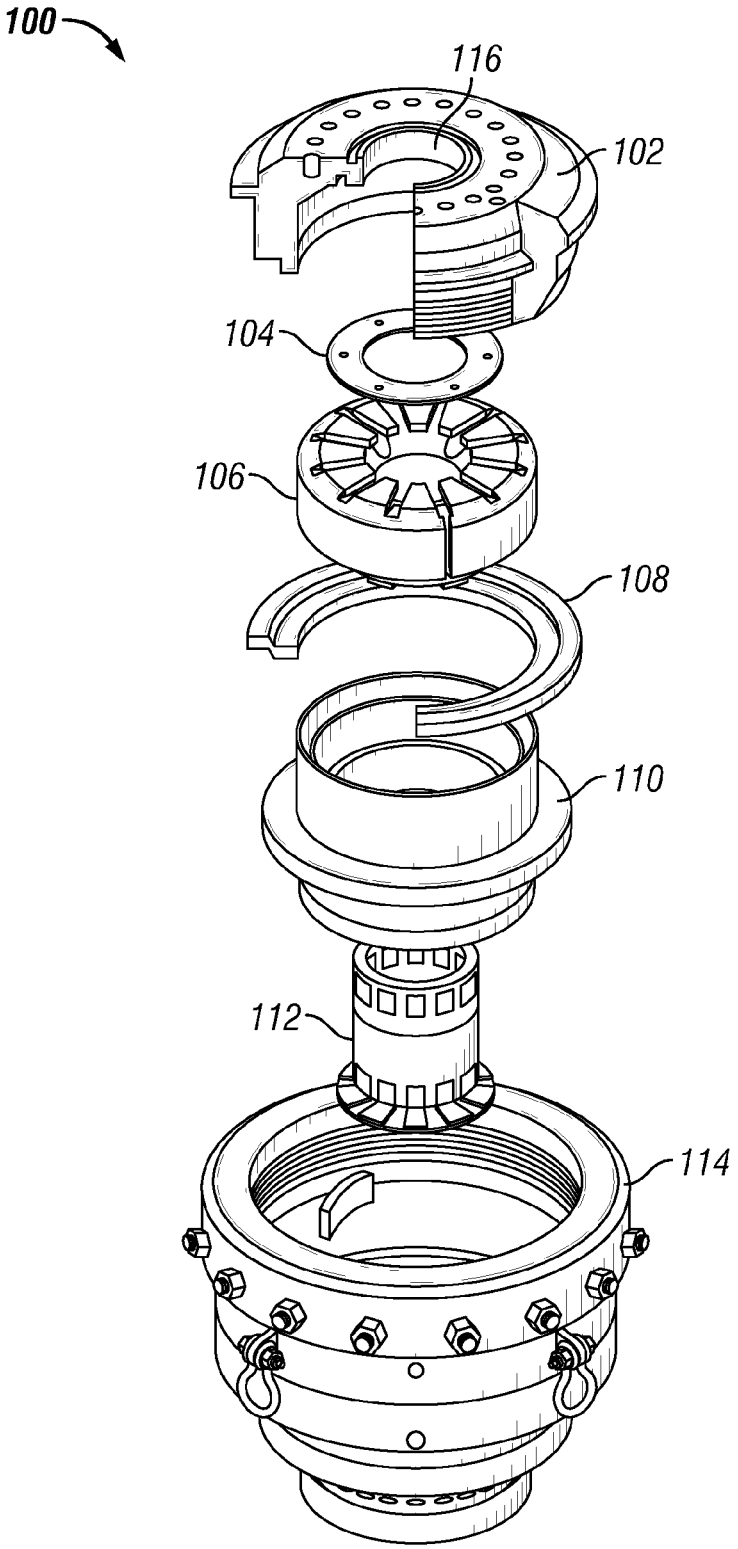
FIG. 1 illustrates an exploded view of an annular BOP, in accordance with example embodiments of the present disclosure.

The present invention relates to a packing unit for annular blowout preventers (BOP) used for well control during completions and workover operations. The packing unit disclosed herein allows for a secondary fluid sealing around irregular shaped pipes and tools, such as ESP bundles, which increases the integrity and effectiveness of the annular blowout preventer.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention may be better understood by reading the following description of non-limiting embodiments with reference to the attached drawing wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for instance, a meaning other than that understood by skilled artisans, such a special definition will be expressly set forth in the specification in a definitional manner that directly and unequivocally provides the special definition for the term or phrase.

Figure 2:
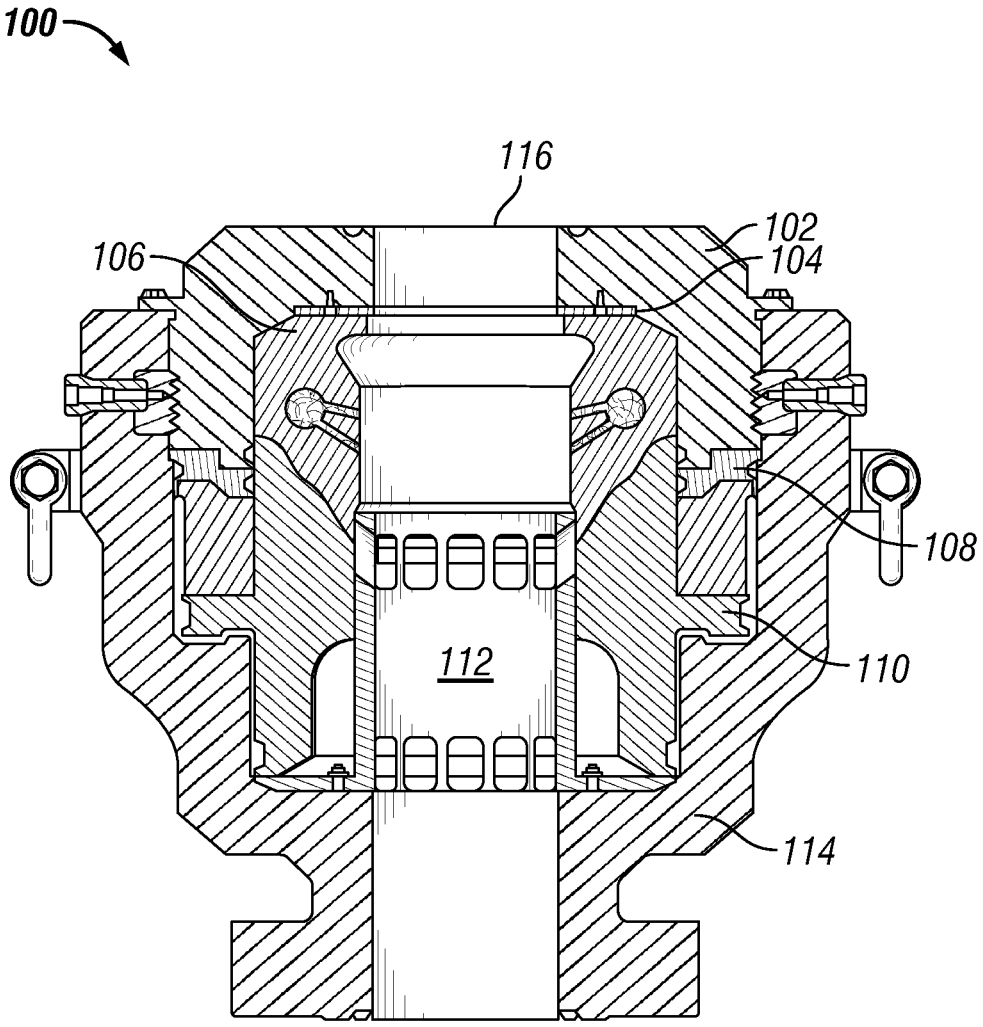
FIG. 2 illustrates a cross-sectional view of the annular BOP of FIG. 1, in accordance with example embodiments of the present disclosure.

FIG. 1 illustrates an exploded view of an annular BOP 100, in accordance with example embodiments of the present disclosure. FIG. 2 illustrates a cross-sectional view of the annular BOP 100. Referring to FIGS. 1 and 2, an example embodiment of the annular BOP 100 includes a latched head 102, a wear plate 104, a packing unit 106, an opening chamber head 108, a piston 110, an inner sleeve 112, and a body 114. A central orifice 116 extends through the BOP 100. During use, a pipe or tool is disposed through the central orifice 116. In certain example embodiments, the packing unit 106 is disposed between the latched head 102 and the piston 110, and the piston is disposed within the body 114. When the BOP 100 is actuated, the piston thrusts upwards, compressing the packing unit 106, which causes the packing unit 106 to constrict. When the packing unit 106 constricts, it tightens around the pipe or tool disposed within the central orifice 116. Constriction of the packing unit 106 around the pipe or tool forms a primary seal.

Figure 3:
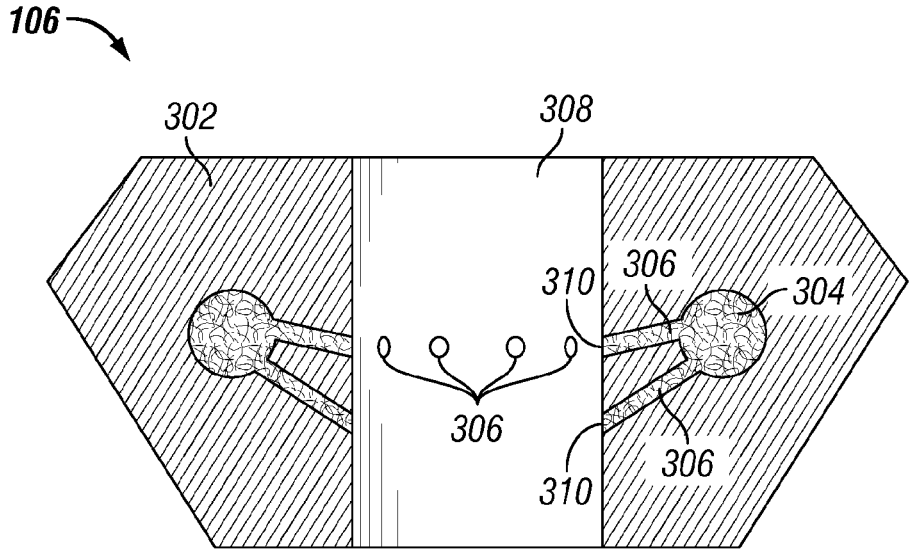
FIG. 3 illustrates a cross-sectional view of the packing unit in a neutral or relaxed state, in accordance with example embodiments of the present disclosure.

FIG. 3 illustrates a cross-sectional view of the packing unit 106 in a neutral or relaxed state, in accordance with example embodiments of the present disclosure. The packing unit 106 includes a packer body 302 surrounding a wellbore opening 308. In certain example embodiments, the packer body 302 is fabricated from a compressible material, a malleable material, a collapsible material, or any combination thereof. In certain example embodiments, the packing unit 106 is fabricated from a plastic or rubber material. In certain example embodiments, the packer body 106 includes one or more internal chambers 304. The internal chamber 304 is filled with a fluid sealing compound. The packer body 106 further includes one or more channels 306 which couple the internal chamber 304 to the opening 308. In certain example embodiments, a breakable seal 310 is disposed or formed between the channels 306 and the opening 308 such that the fluid sealing compound is retained within the internal chamber and channels 306 when the packing unit 106 is in the neutral state.

Figure 4:
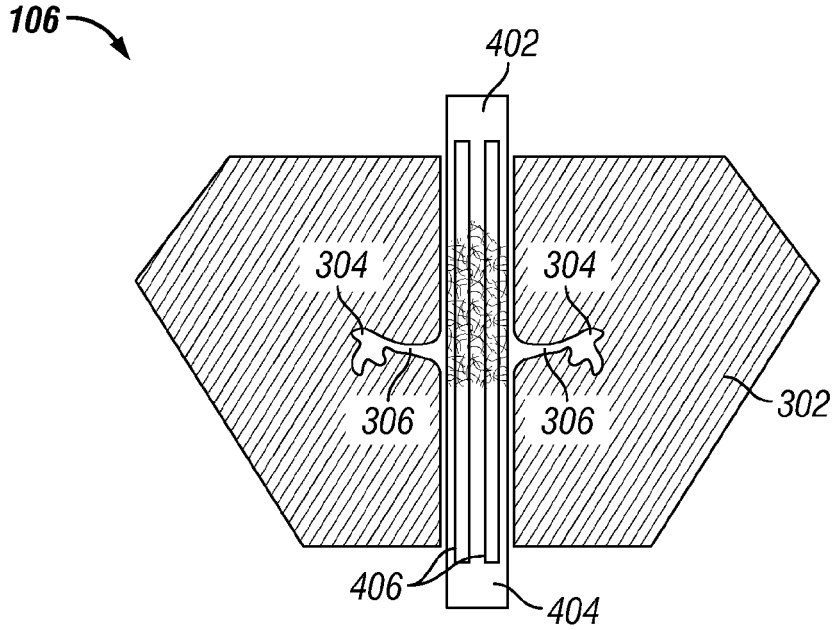
FIG. 4 illustrates a cross-sectional view of the packing unit of FIG. 3 in a compressed state, in accordance with example embodiments of the present disclosure.

FIG. 4 illustrates a cross-sectional view of the packing unit 106 in a compressed state, and with a tool 402 disposed therethrough. When the annular BOP 100 is actuated, the piston is urged onto the packing unit 106, which causes the packing unit 106 to compress. In certain example embodiments, compression of the packing unit 106 causes the fluid sealing compound to be squeezed out of the internal chamber 304 and into the opening 308 via the one or more channels 306. The pressure on the fluid sealing compound from the compression of the packing unit 106 is large enough to force the fluid sealing compound out of the breakable seal 310. In certain example embodiments, the breakable seal 310 is replaced by a separation device such as a one-way valve which allows the fluid sealing compound to be released when a sufficient pressure is applied.

In certain example embodiments, the fluid sealing compound forms around the tool after exiting the packing unit 106. The fluid sealing compound fills in any crevices or recesses around the tool, forming a solid seal around the tool 402. In certain example embodiments, the fluid sealing compound fills in any gaps between the packing unit and the tool 402. In certain example embodiments, the fluid sealing compound hardens around the tool. In an example application, as illustrated in FIG. 4, the tool 402 includes a pipe 404 and one or more wires 406 running along the pipe 404. In one example embodiment, an electric submersible pump (ESP) is installed in a well. In an example application, the ESP includes thousands of feet of tubing, hydraulic control lines, power cables, and electric control line which are installed in the well through the annular BOP 100. These lines and cables are clamped against the production tubing, which forms small crevices between the outer perimeter of the wires and the outer perimeter of the tubing. The annular BOP 100 surrounds the production tubing and said cables and wires. During a well control event when the annular BOP 100 is actuated, the fluid sealing compound exits the packing unit 106 and fills in said crevices, forming a solid seal between the annular BOP 106 and the production tubing.

In certain example embodiments, the internal chamber 304 is formed as a continuous ring disposed within the packer body 302 of the packing unit 106 and surrounds the opening 308. In certain such example embodiments, the internal chamber 304 is coupled to the opening 308 via a plurality of channels disposed at various point around the internal chamber 304. In certain example embodiments, the internal chamber 304 is forms as a pocket disposed within the packer body 302. In certain example embodiments, the packing unit 106 includes a plurality of separate internal chambers 304. In certain such example embodiments, the plurality of separate internal chambers 304 each are filled with the same fluid sealing compound and are each coupled to the opening 308 by a separate channel 306.

In certain other example embodiments, a first internal chamber is filled with a first fluid sealing compound and a second internal chamber is filled with a second fluid sealing compound. In certain example embodiments, the first and/or second sealing compound are in pure or viscous form or in solution. In certain example embodiments, when the annular BOP is actuated, the first and second sealing compounds are both expelled from the packing unit 106 and mix. Mixing of the first and second sealing compounds forms a mixture which hardens and forms a seal. The internal chamber 304 can have any shape or be any type of void within the packer body 302 of the packing unit 106 which allows the fluid sealing compound to be retained therewithin during a neutral state and which allows the fluid sealing compound to be expelled into the opening 308 from the packing unit 106 when the annular BOP 100 is actuated.

In certain example embodiments, the fluid sealing compound can be any type of suitable material which deforms under applied shear stress and can flow or be expelled from the internal chamber and fill any crevices or gaps between the tool 402 and the packing unit 106. The fluid sealing compound remains between the tool 402 and the packing unit 106. Non-limiting examples of the fluid sealing compound include: heavy grease, epoxy resin materials, polyurethane gels or caulk material, crosslinked polymer solution, and other highly-viscous solutions with the capability to be extruded into the annular space with pressure. The fluid sealing compounds may also be in various forms prior to entrance to the wellbore to form an annular seal, including pure liquid form, viscosified liquid form, low-viscosity solution, and pressurized form (to render a foam upon release into the wellbore). In certain example embodiments, the fluid sealing compound forms a permanent seal around the tool 402. In certain example embodiments, the fluid sealing compound forms a semi-permanent seal around the tool 402, which can be easily removed. In certain example embodiments, the packing unit 106 includes a port (not shown) coupled to the internal chamber 304. The port allows additional fluid sealing compound to be injected into the internal chamber 304. In certain such example embodiments, this allows the internal chambers 304 to be refilled with sealing compound for multiple uses. In certain example embodiments, the packing unit 106 includes at least two different reactive materials which mix to form the sealing agent, such as resin or foam.

Figure 5:
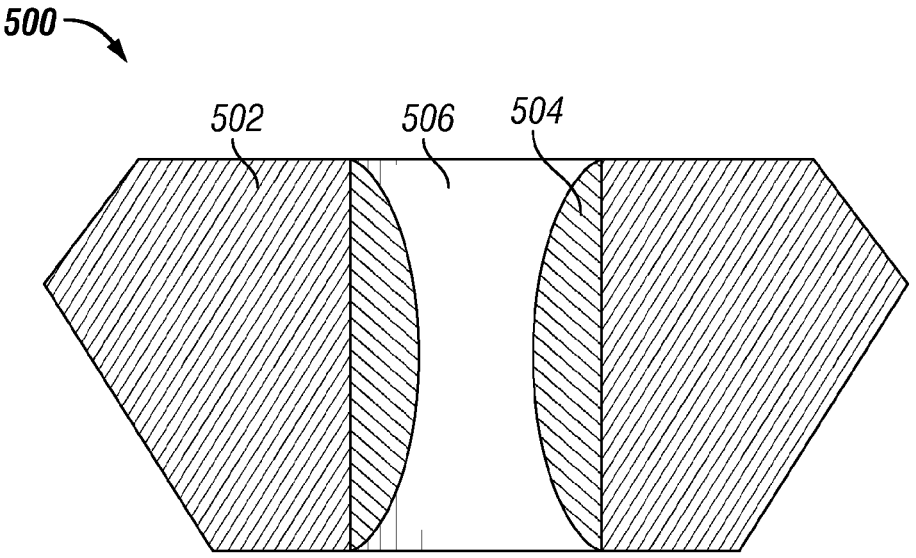
FIG. 5 illustrates a packing unit with secondary sealing, in accordance with example embodiments of the present disclosure.

FIG. 5 illustrates a packing unit 500 with secondary sealing, in accordance with example embodiments of the present disclosure. In certain example embodiments, the packing unit 500 includes an packer body 502 surrounding an opening 506. In certain example embodiments, the packer body 502 is fabricated from a first material such as nitrite, rubber, or urethane. In certain example embodiments, the packing unit further includes a second material 504 disposed between the packer body 502 and the opening 506, the second material 504 being less rigid than the first material. In certain example embodiments, the second material 504 includes a catalyst, crosslinker, curing agent, hardening agent, or other compound with a reactive affinity toward the sealing compound held within the first chamber. During use, the packing unit 500 is disposed within an annular BOP, such as that shown in FIGS. 1 and 2. When the annular BOP is actuated, the packer body 502 and the second material 504 constrict the opening 506. The second material creates a seal around any tool disposed within the opening. In certain example embodiments, the second material fills in one or more crevices or recesses on an outer perimeter of the tool. In certain example applications, the first and second materials would be chosen to be compatible with downhole environments, including temperature, pressure, and chemical considerations.

Figure 6:
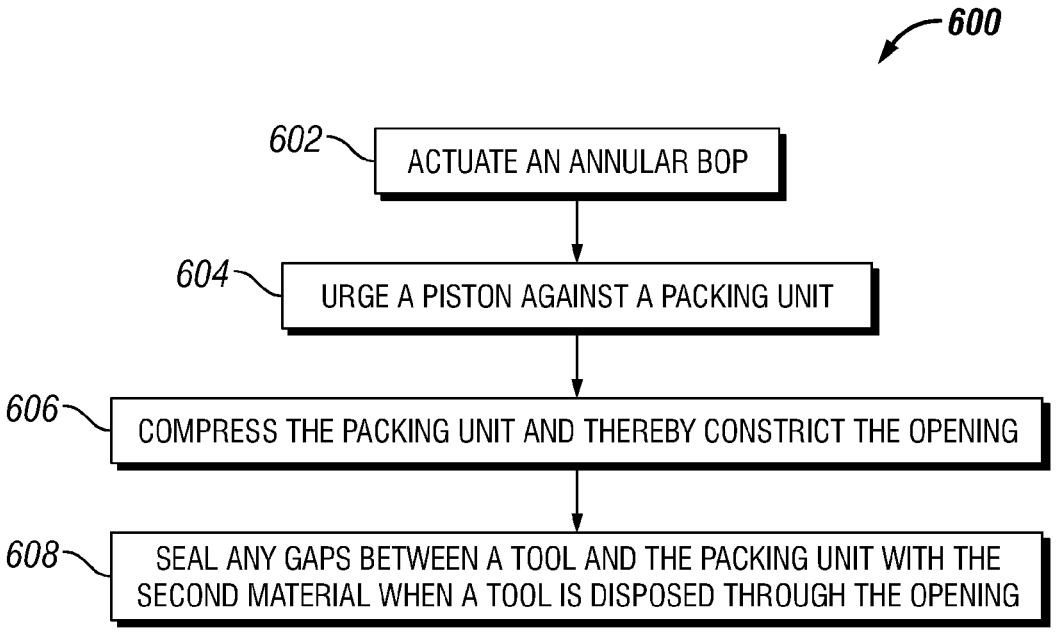
FIG. 6 illustrates a method of sealing a well, in accordance with example embodiments of the present disclosure.

FIG. 6 illustrates a method 600 of sealing a well, in accordance with example embodiments of the present disclosure. The method 600 includes actuating an annular BOP (step 602). In certain example embodiments, the blowout preventer includes a piston and a packing unit. The packing unit comprising a packer body having an opening formed therethrough. The method 600 further includes urging a piston against a packing unit (step 604). In certain example embodiments, the packing unit includes a first material and a second material, the second material having a rigidity lesser than that of the first material. The method includes compressing the packing unit and thereby constricting the opening (step 606). In certain example embodiments, the packing unit is made of a compressible material. The method also includes sealing any gaps between a tool and the packing unit with the second material when a tool is disposed through the opening (step 608). The packing unit includes an packer body fabricated from the first material. In certain example embodiments, the second material is disposed within the packer body in an internal chamber formed within the packer body. In such example embodiments, the second material, a fluid sealing compound, is expelled from the internal chamber and into the opening when the packing unit is compressed. The fluid sealing compound flows into any crevices between a tool disposed in the opening and the packing unit. In certain example embodiments, the packing unit is disposed around a pipe. In certain such example embodiments, the pipe is irregularly shaped or includes a plurality of wires/cables disposed on the surface. In other example embodiments, the second material is disposed between the first material and the opening, and forms around the tool, filling in any crevices between the tool and the packing unit when the annular BOP is actuated.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. While numerous changes may be made by those skilled in the art, such changes are encompassed within the spirit of this invention. Furthermore, no limitations are intended to the details of construction or design herein shown. It is therefore evident that the particular illustrative embodiments disclosed above may be altered or modified and all such variations are considered within the scope and spirit of the present invention.

What is claimed is:

1. An annular blowout preventer, comprising:

a body;

a piston disposed within the body; and a packing unit disposed adjacent the piston, the packing unit comprising:

a packer body surrounding an opening;

an internal chamber formed within the packer body, the internal chamber filled with a fluid sealing compound;

a channel in fluid communication with the chamber; and a separation between the channel and the opening, wherein, upon actuation of the annular blowout preventer, at least a portion of the fluid sealing compound is configured to be expelled through the separation in fluid form and into the opening when the packing unit is compressed; and wherein the packing unit is compressed when the piston is urged against the packing unit during actuation of the annular blowout preventer.

2. The annular blowout preventer of claim 1, wherein the sealing compound is an epoxy resin, a jelly sealant, polyurethane material, or foamed derivatives of these materials.

3. The annular blowout preventer of claim 2, wherein the sealing compound is modified to provide sufficient setting time or delay of sealant at downhole conditions through inclusion of one or more chemical delay agents or activators.

4. The annular blowout preventer of claim 1, wherein the separation comprises a breakable seal.

5. The annular blowout preventer of claim 1, wherein the fluid sealing compound is formulated to harden after exiting the packer body into the opening and being exposed to downhole conditions.

6. The annular blowout preventer of claim 1, wherein the packer body is fabricated from a compliant rubber material.

7. The annular blowout preventer of claim 1, wherein the fluid sealing compound is retained within the internal chamber when the packing unit is in the neutral state.

8. The annular blowout preventer of claim 1, further comprising a second internal chamber filled with a second fluid sealing compound, the second internal chamber configured to be compressed by the piston upon actuation of the annular blowout preventer, wherein, upon actuation, at least a portion of the second fluid sealing compound is configured to flow out of the second internal chamber, and mix with the fluid sealing compound to form a seal.

9. The annular blowout preventer of claim 8, wherein the second fluid sealing compound comprises a catalyst, crosslinker, curing agent, hardening agent, or other compound with a reactive affinity toward the fluid sealing compound held within the internal chamber.

10. A method of sealing a well, comprising:

actuating an annular blowout preventer, wherein the blowout preventer comprises a piston and a packing unit, the packing unit comprising a packer body having an opening formed therethrough;

urging the piston against the packing unit, wherein the packing unit comprises a first material which is in a solid form and a second material which is in a fluid form when within the packing unit;

compressing the packing unit and thereby constricting the opening with the first material; and sealing gaps between a tool and the first material with the second material when the tool is disposed through the opening.

11. The method of claim 10, wherein the second material is disposed in an internal chamber within the packing unit when the annular blowout preventer is in a neutral state, and wherein the internal chamber is coupled to the opening via one or more channels.

12. The method of claim 11, further comprising:

expelling the second material from the internal chamber and into the opening when the packing unit is compressed; and flowing the second material around the tool and filling in any gaps between the tool and the first material.

13. The method of claim 12, further comprising:

expelling a third material from a second internal chamber and into the opening when the packing unit is compressed; and mixing the third material and the second material to form a sealing agent, the sealing agent filling in any gaps between the tool and the first material.

14. The method of claim 13, wherein the third material is a catalyst, crosslinker, curing agent, hardening agent, or other compound with a reactive affinity toward the second material.

15. The method of claim 10, wherein the first material is nitrite, urethane, or any combination thereof, and wherein the second material comprises epoxy resin, sealant jelly, caulk, polyurethane, sealant composites, the precursor additives to provide these compounds, or any combination thereof.

16. The method of claim 10, wherein the second material hardens after exiting the packer body into the opening.

17. A method of sealing an annulus of a well, comprising:

actuating an annular blowout preventer, wherein the annular blowout preventer comprises a packing unit and an internal chamber connected to an annulus, wherein the internal chamber comprises a sealing compound in a fluid state;

constricting the packing unit such that the packing unit tightens around an internal pipe;

expelling at least a portion of the fluid sealing compound from the internal chamber into the annulus;

hardening the sealing compound such that a hardened sealing compound and the packing unit form a seal within the annulus.

18. The method of sealing an annulus of a well of claim 17, wherein the hardening of the sealing compound is triggered by a second compound with a reactive affinity toward the sealing compound.

19. The method of sealing an annulus of a well of claim 17, wherein the annular blowout preventer additionally comprises a piston adjacent to the packing unit, wherein the piston constricts the packing unit and expels the fluid sealing compound when the annular blowout preventer is actuated.

20. The method of sealing an annulus of a well of claim 17, further comprising a breakable seal between the internal chamber and the annulus.

* * * * *